US009958219B2

(12) United States Patent
Gosioco et al.

(10) Patent No.: US 9,958,219 B2
(45) Date of Patent: May 1, 2018

(54) HEAT EXCHANGER AND DYNAMIC BAFFLE

(71) Applicant: DENSO International America, Inc., Southfield, MI (US)

(72) Inventors: Delomer Gosioco, Royal Oak, MI (US); Shawn Westergaard, Sterling Heights, MI (US); David Korenchuk, Royal Oak, MI (US)

(73) Assignee: DENSO International America, Inc., Southfield, MI (US)

( * ) Notice: Subject to any disclaimer, the term of this patent is extended or adjusted under 35 U.S.C. 154(b) by 165 days.

(21) Appl. No.: 14/946,962

(22) Filed: Nov. 20, 2015

(65) Prior Publication Data

US 2017/0146307 A1 May 25, 2017

(51) Int. Cl.

| | |
|---|---|
| ***F28F 27/00*** | (2006.01) |
| ***F28F 9/22*** | (2006.01) |
| ***F28D 7/00*** | (2006.01) |
| ***F28F 9/02*** | (2006.01) |

(52) U.S. Cl.

CPC ..... *F28F 9/22* (2013.01); *F28D 7/0066* (2013.01); *F28F 9/02* (2013.01)

(58) Field of Classification Search

CPC ..... F28F 9/22; F28F 9/02; F28D 7/0066

USPC ..... 165/96

See application file for complete search history.

(56) References Cited

U.S. PATENT DOCUMENTS

| | | | | | |
|---|---|---|---|---|---|
| 2,200,787 | A * | 5/1940 | Coy | F28F 9/22 | 165/160 |
| 4,098,328 | A * | 7/1978 | Cheong | F28F 9/0231 | 123/41.54 |
| 4,593,749 | A * | 6/1986 | Schatz | B60H 1/02 | 165/101 |
| 5,067,561 | A * | 11/1991 | Joshi | F01P 11/08 | 123/41.33 |
| 5,186,245 | A * | 2/1993 | Peters | F28F 9/0234 | 165/140 |
| 5,452,686 | A * | 9/1995 | Stahl | F22B 1/1884 | 122/135.1 |
| 2007/0175612 | A1* | 8/2007 | Hendrix | F02B 29/0418 | 165/101 |
| 2008/0029254 | A1 | 2/2008 | Sekito et al. | | |

FOREIGN PATENT DOCUMENTS

| | | | | |
|---|---|---|---|---|
| CA | 2018706 A1 * | 1/1991 | F28F 9/22 | |
| DE | 3103198 A1 * | 8/1982 | B60H 1/02 | |

* cited by examiner

*Primary Examiner* — Len Tran
*Assistant Examiner* — Paul Alvare

(57) ABSTRACT

A heat exchanger includes tubes having tube inlets, an inlet tank having therein an inlet tank space, and a dynamic baffle disposed in the inlet tank space. The inlet tank has a tank inlet. The tubes include first tubes and second tubes. The first tubes are closer to the tank inlet than the second tubes are to the tank inlet. The first tubes include a nearest tube that is, among the tubes, closest to the tank inlet. The dynamic baffle is configured to, when the fluid pressure of the thermal fluid in the inlet tank space is below a specified value, suppress the flow rates of the plurality of first tubes, and, when the fluid pressure of the thermal fluid in the inlet tank space is at or above the specified value, increase the flow rate of at least one of the plurality of the first tubes.

9 Claims, 7 Drawing Sheets

HEAT EXCHANGER AND DYNAMIC BAFFLE

TECHNICAL FIELD

The present disclosure relates to a heat exchanger having a dynamic baffle to adjust a flow of thermal fluid flowing through an inlet tank and the dynamic baffle.

BACKGROUND

A heat exchanger includes a plurality of tubes and fins, an inlet tank, and an outlet tank. The inlet tank and the outlet tank are in fluid communication with the plurality of tubes through inlets and outlets formed at respective ends of the tubes. Thermal fluid in the inlet tank flows into the tubes through the inlets and the thermal fluid flows through the tubes while exchanging heat with air. Then, the thermal fluid flows into the outlet tank through the outlets after the heat exchange.

Generally, a flow rate of the thermal fluid for each tube may influence heat exchanging performance of a heat exchanger. For example, when the flow rates of the thermal fluid flowing through tubes are low, the heat exchanging performance may decrease, whereas when the flow rates of the thermal fluid is high, the heat exchanging performance may increase.

SUMMARY

This section provides a general summary of the disclosure, and is not a comprehensive disclosure of its full scope or all of its features.

An aspect of the present disclosure provides for a heat exchanger that includes tubes having tube inlets, an inlet tank having an inlet tank space within the inlet tank, and a dynamic baffle disposed in the inlet tank space. The inlet tank has a tank inlet. The tubes include first tubes and second tubes. The first tubes are closer to the tank inlet than the second tubes are to the tank inlet. The first tubes include a nearest tube that is, among the tubes, closest to the tank inlet. The dynamic baffle is configured to (i) suppress the flow rates of the plurality of first tubes when the fluid pressure of the thermal fluid in the inlet tank space is below a specified value and (ii) increase the flow rate of at least one of the plurality of the first tubes when the fluid pressure of the thermal fluid in the inlet tank space is at or above the specified value.

According to the aspect of the present disclosure, the dynamic baffle is disposed inside the inlet tank space to adjust a flow of the thermal fluid. The dynamic baffle may be configured to increase the flow rate of at least one of the plurality of the first tubes when the fluid pressure of the thermal fluid in the inlet tank space is at or above the specified value.

BRIEF DESCRIPTION OF THE DRAWINGS

The above and other objects, features and advantages of the present invention will become more apparent from the following detailed description made with reference to the accompanying drawings. In the drawings.

Figure 1:
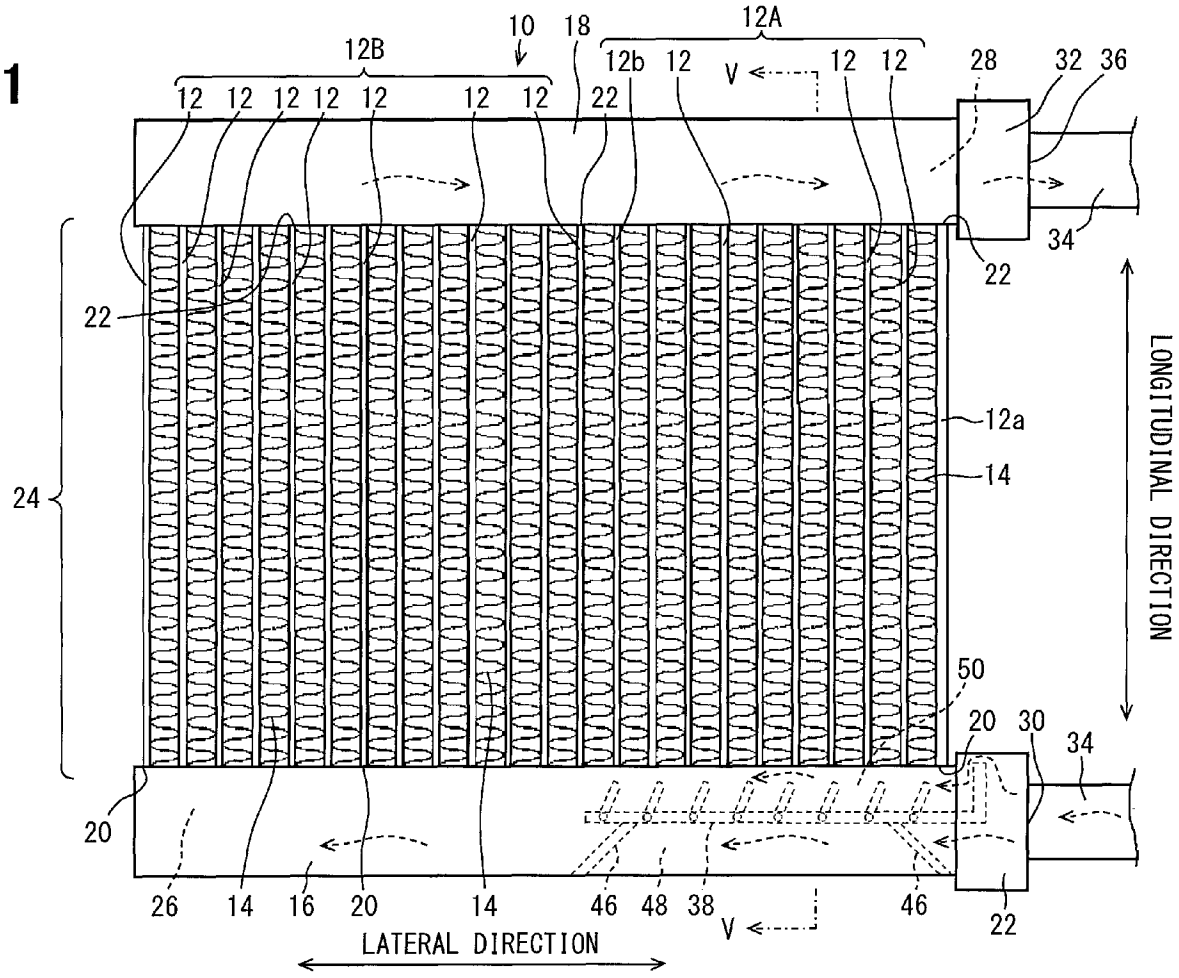
FIG. 1 is a diagram illustrating a heat exchanger according to a first embodiment.

Further areas of applicability will become apparent from the description provided herein. The description and specific examples in this summary are intended for purposes of illustration only and are not intended to limit the scope of the present disclosure.

DETAILED DESCRIPTION

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts may be combined. The embodiments may be partially combined even if it is not explicitly described that the embodiments may be combined, provided there is no harm in the combination.

(First Embodiment)

FIG. 1 illustrates a heat exchanger 10 according to the first embodiment. In the first embodiment, the heat exchanger 10 is disposed in an air conditioning unit (not shown), which may be mounted to a vehicle (not shown), and the heat exchanger 10 serves as "a heater core" for the air conditioning unit. The heat exchanger 10 includes a plurality of tubes 12, a plurality of fins 14, an inlet tank 16, and an outlet tank 18. The heat exchanger 10 forms a portion of a coolant circuit (not shown) which circulates thermal fluid, such as coolant, water or the like for cooling an engine (not shown) of the vehicle. In the present embodiment, the thermal fluid heated by the engine flows into the heat exchanger 10.

The tubes 12 extend along a longitudinal direction to be parallel with each other, and the thermal fluid flows through the tubes 12. Each tube 12 includes one end having a tube inlet 20 and the other end having a tube outlet 22. Each of the fins 14 is formed in a wave form and extends along the longitudinal direction to be parallel with each other. The tubes 12 and the fins 14 are arranged alternately along a lateral direction, or a first direction, which is perpendicular to the longitudinal direction, and form a core 24 of the heat exchanger 10. Air passages are defined between each of the fins 14 and adjacent tubes 12, and air flows through these air passages in an airflow direction. The airflow direction is perpendicular to both the lateral direction and the longitudinal direction. The fins 14 enhance a heat exchanging performance of the heat exchanger 10 between the thermal medium, which flows through the tubes 12, and air, which passes through the air passages.

The inlet tank 16 and the outlet tank 18 are disposed at opposite sides of the core in the longitudinal direction. The one end and the other end of each tube are connected to, respectively, the inlet tank 16 and the outlet tank 18. The tubes 12 are connected to the inlet tank 16 and the outlet tank 18 along the lateral direction. An inlet tank space 26 is defined inside the inlet tank 16 to extend along the lateral direction. The inlet tank space 26 is in fluid communication with each tube 12 through each tube inlet 20. Likewise, an outlet tank space 28 is defined in the outlet tank 18 to extend in the lateral direction and the outlet tank space 28 is in fluid communication with each tube through each tube outlet 22.

The inlet tank 16 has a tank inlet 30 at one end of the inlet tank 16 in the lateral direction. The other end of the inlet tank 16 is a closed end. The inlet tank 16 has, at the one end, a connecting portion 32 that is connected to a circulation pipe 34 of the coolant circuit. The thermal fluid flows into the inlet tank space 26 through the tank inlet 30 and flows out of the inlet tank space 26 through each tube inlet 20 of each tube 12 at a respective flow rate for each tube 12.

The outlet tank 18 has a tank outlet 36 at one end of the outlet tank 18 in the lateral direction. The other end of the outlet tank 18 is a closed end. The outlet tank 18 has, at the one end, a connecting portion 32 that is connected to a circulation pipe 34 of the coolant circuit. The thermal fluid flows into the outlet tank space 28 through the tube outlets 22 of the tubes 12 at a respective flow rate for each tube 12, and flows out of the outlet tank space 28 through the tank outlet 36.

In the present embodiment, a dynamic baffle 38 is disposed inside the inlet tank space 26. The dynamic baffle 38 is positioned close to the tank inlet 30 of the inlet tank 16. The dynamic baffle 38 is arranged to extend from the tank inlet 30 to a position close to the center of the inlet tank space 26 in the lateral direction. The dynamic baffle 38 is configured to adjust a flow rate of the thermal fluid at each tube inlet 20 by directing the flow of the thermal fluid flowing through the inlet tank space 26.

Here, the tubes 12 are categorized into a plurality of first tubes 12A and a plurality of second tubes 12B, and the plurality of second tubes 12B are positioned further from the tank inlet 30 of the inlet tank 16 than the first tubes 12A are. The first tubes 12A include a nearest tube 12*a* that is, among all of the tubes 12, closest to the tank inlet 30. In the present embodiment, the dynamic baffle 38 is configured to adjust the flow rates of the thermal fluid in the first tubes 12A.

Figure 2:
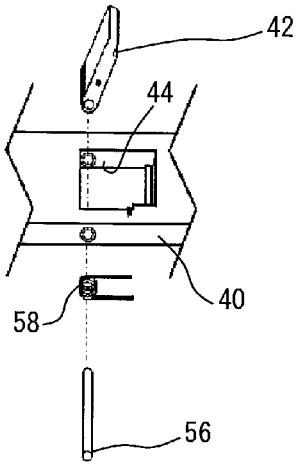
FIG. 2 is an exploded perspective view of a dynamic baffle.
Figure 4:
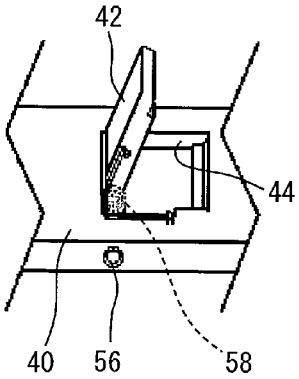
FIG. 4 is a perspective view of the dynamic baffle when the opening is open.
Figure 3:
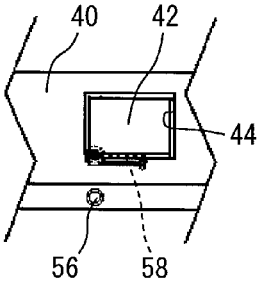
FIG. 3 is a perspective view of the dynamic baffle when an opening is closed by a door.

As shown in FIGS. 2 to 4, the dynamic baffle 38 includes a plate member 40 (body), a plurality of doors 42, and a plurality of openings 44 formed in the plate member 40. The plate member 40 has an elongated shape and extends in the lateral direction inside the inlet tank space 26. The plate member 40 is fixed to a bottom of the inlet tank 16 through supporting members 46. The supporting members 46 hold the plate member 40 away from the bottom of the inlet tank 16 by a specified distance. Thus, the plate member 40 defines a first space 48 and a second space 50 inside the inlet tank space 26.

Figure 5:
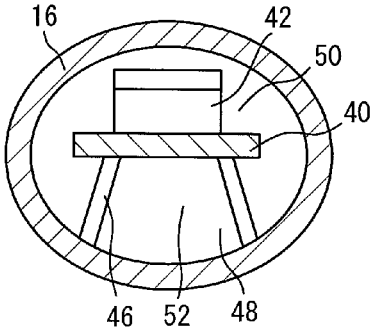
FIG. 5 is a cross-sectional view of an inlet tank along V-V line in FIG. 1.

The first space 48 and the second space 50 are separated by the plate member 40 in the longitudinal direction. The second space 50 is closer to the first tubes 12A than the first space 48 is. The second space 50 is in fluid communication with the tubes 12 through the tube inlets 20. As shown in FIG. 5, a through-opening 52 is formed in each supporting member 46 to allow the thermal fluid to flow therethrough. Accordingly, the thermal fluid that passed through the tank inlet 30 may flow into the first space 48 through the through-openings 52.

An interfering wall 54 is formed in the plate member 40 at one end of the plate member 40 close to the tank inlet 30. The interfering wall 54 extends toward the outlet tank 18 along the longitudinal direction. The distal end of the interfering wall 54 is positioned close to an internal surface of the connecting portion 32 so that a small space is defined between the distal end and the internal surface of the connecting portion 32. By providing the interfering wall 54, the amount of the thermal fluid flowing into the second space 50 may be suppressed compared to the amount of the thermal fluid flowing into the first space 48 (refer to FIG. 6).

Each opening 44 is disposed adjacent to a respective first tube 12A. As shown in FIGS. 2 to 4, each opening 44 has a rectangular shape. The first and second spaces 48, 50 are in fluid communication with each other through the openings 44. Each door 42 is disposed adjacent to a respective opening 44, and therefore adjective to a respective first tube 12A. The door 42 is rotatably connected to the plate member 40 by a pin 56. The door 42 is configured to rotate about the pin 56 to selectively open and close its respective opening 44.

The dynamic baffle 38 further includes a plurality of torsion springs 58 (biasing members). The torsion springs 58 are disposed in the plate member 40 and connected to respective ones of the doors 42. The torsion spring 58 is configured to apply a biasing force to the door 42 in a closing direction such that the door is biased to rotate in the closing direction to close the opening 44. In the present embodiment, the biasing force of each torsion spring 58 may have a substantially same value.

In the present embodiment, the door 42 is configured to close the opening 44 due to the biasing force from the torsion spring 58 when the fluid pressure of the thermal fluid in the inlet tank 16 is below a first specified value (specified value). In other words, the biasing force of the torsion spring 58 may be set such that the door 42 remains closed when the fluid pressure of the thermal fluid is below the first specified value. In the present embodiment, the first specified value may be, for example, a pressure corresponding to the engine operating in a middle operation state. In other words, when the fluid pressure of the thermal fluid in the inlet tank space 26 is below the first specified value, the engine may be in a low operation state, such as an idle state.

Figure 6:
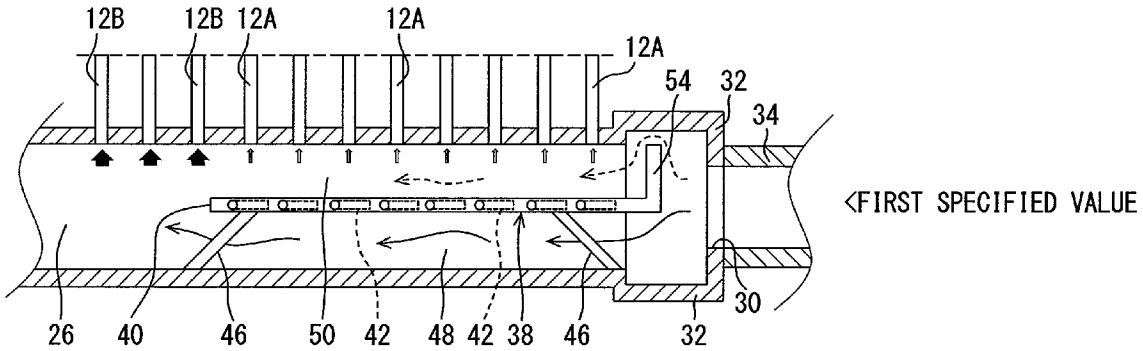
FIG. 6 is a cross-sectional view of the inlet tank when fluid pressure in an inlet tank space is below a first specified value.

When all of the openings 44 are closed by the doors 42 as shown in FIG. 6, the dynamic baffle 38 prohibits the thermal fluid from flowing through the openings 44 from the first space 48 to the second space 50. As a result, the thermal fluid flowing in the second space 50 mainly flows into the tube inlets 20 of the first tubes 12A, whereas the thermal fluid flowing in the first space 48 mainly passes through the first space 48 toward the second tubes 12B, without flowing into the first tubes 12A. Thereafter, the thermal fluid that passed through the first space 48 flows into the second tubes 12B through the tube inlets 20. Accordingly, when the fluid pressure is below the first specified value, the flow rates of the thermal fluid in the first tubes 12A may be suppressed compared to the flow rates of the thermal fluid in the second tubes 12B. Without the dynamic baffle 38, during a low fluid pressure condition (i.e., when the fluid pressure is below the first specified value), the thermal fluid would mostly flow through the first tubes 12A and result in an unbalanced thermal distribution in the core 24. By providing the dynamic baffle 38 of the present embodiment, an increased amount of the thermal fluid may flow into the second tubes 12B when the fluid pressure of the thermal fluid is below the first specified value. Hence, the distribution of the thermal fluid across the core may be improved during the low fluid pressure condition such as an idle state of the engine.

Figure 7:
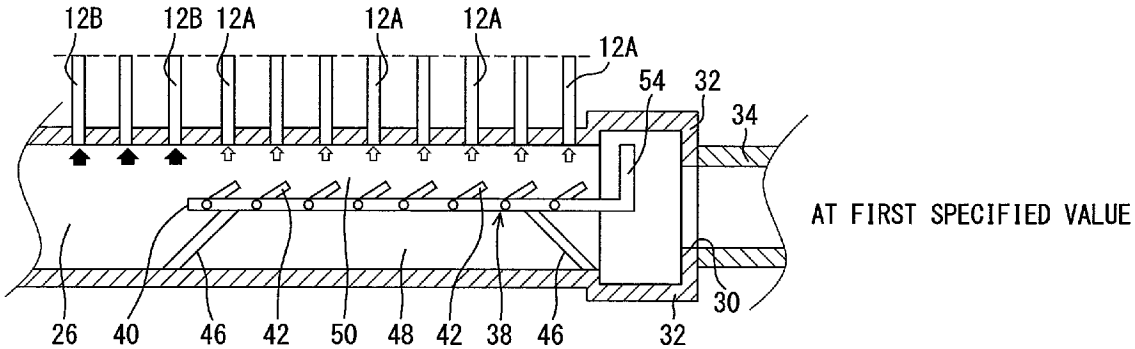
FIG. 7 is a cross-sectional view of the inlet tank when the fluid pressure in the inlet tank space is at the first specified value.

Conversely, when the fluid pressure in the inlet tank space 26 is at or above the first specified value, all of the doors 42 are configured to concurrently rotate, due to the fluid pressure, in an opening direction against the biasing force of the torsion springs 58 to open the openings 44. In other words, all of the doors 42 rotate at substantially the same time when the fluid pressure in the inlet tank space 26 reaches the first specified value. As shown in FIG. 7, when the fluid pressure is at the first specified value, each door is angled relative to the plate member 40 (i.e., the lateral direction) at substantially the same angle. Thus, the thermal fluid in the first space 48 is allowed to flow into the second space 50 through the openings 44 when the doors 42 are open. In other words, the dynamic baffle 38 reduces flow resistance between the first space 48 and the second space 50. As a result, the flow rate of the thermal fluid flowing into the second space 50 increases, whereby the flow rates of the thermal fluid at the tube inlets 20 of the first tubes 12A may also increase. Accordingly, desirable distribution of the thermal fluid to across the core 24 may be attained during the middle operation state. As a result, it is possible to avoid a situation where the total flow capacity of the core 24 would become insufficient when the engine changes from the low operation state (e.g., an idle state) to the middle operation state (e.g., vehicle in motion with a low speed).

When the fluid pressure in the inlet tank space 26 further rises according to an increase in engine load, the doors 42 further rotate in the opening direction. That is, each door 42 rotates proportionally with the increase in the fluid pressure in the inlet tank space 26. In other words, the dynamic baffle 38 further reduces the flow resistance between the first space 48 and the second space 50. The flow rates of the thermal fluid in the first tubes 12A may further increase as the doors 42 rotate with the fluid pressure (i.e., as the fluid pressure in the inlet tank space 26 increases). Hence, the desirable distribution of the thermal fluid to across the core 24 may be maintained as the engine load increases.

Figure 8:
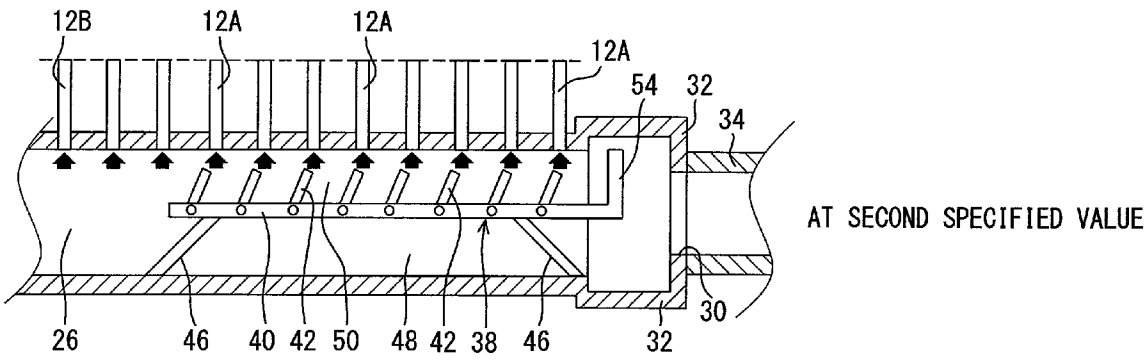
FIG. 8 is a cross-sectional view of the inlet tank when the fluid pressure in the inlet tank space is at a second specified value.

When the engine load is further increased and the fluid pressure reaches a second specified value, each door 42 rotates to a maximum angle (for example, 80 degrees between the door 42 and the plate member 40) as shown in FIG. 8. In other words, the dynamic baffle 38 minimizes the flow resistance between the first space 48 and the second space 50. The fluid pressure may be at the second specified value when, for example, the engine is in a high operation state (e.g., the vehicle in motion with a high speed). When the doors 42 are at the maximum angle, the flow rates of the thermal fluid in the first tubes 12A may further increase to substantially the same value as those of the second tubes 12B. As a result, the desirable distribution of the thermal fluid across the entire core 24 may be provided when the engine is in the high operation state.

As described above, when the fluid pressure of the thermal fluid is below the first specified value, the dynamic baffle 38 suppresses the flow rates of the first tubes 12A (refer to FIG. 6). Therefore, when the engine is in the low operation state, the thermal fluid in the first space 48 is mostly diverted toward the second tubes 12B. Conversely, when the fluid pressure of the thermal fluid is at or above the first specified value as shown in FIGS. 7 and 8, the dynamic baffle 38 increases the flow rates of the first tubes 12A. Therefore, the dynamic baffle 38 may allow the thermal fluid to flow more evenly across both the first tubes 12A and the second tubes 12B when the engine is in the middle or high operation state.

(Second Embodiment)

FIGS. 9 to 12 show a dynamic baffle 38 according to the second embodiment. Each torsion spring 58 of the dynamic baffle 38 according to the second embodiment has a different biasing force. More specifically, the biasing force of one of the torsion springs 58, which is located farther from the tank inlet 30 than others of the torsion springs 58 are, is set to be less than the biasing forces of the others of the torsion springs 58. That is, the torsion spring 58 farthermost from the tank inlet 30 has the lowest biasing force, and the biasing force of the torsion springs 58 gradually increases from the farthermost torsion spring 58 to a nearest torsion spring 58, which is closest to the tank inlet 30 among the torsion springs 58. Thus, the nearest torsion spring 58 has the highest biasing force. Hereinafter, the door 42 that is farthermost from the tank inlet 30 is referred as "farthermost door 42*b*" and the door 42 that is closest to the tank inlet 30 is referred as "nearest door 42*a*". Furthermore, the first tube 12A that is farthermost from the tank inlet 30 among the first tubes 12A is referred as "farthermost tube 12*b*", to which the farthermost door 42 is adjacent. It should be noted that the nearest door 42*a* is adjacent to the nearest tube 12*a*.

Figure 9:
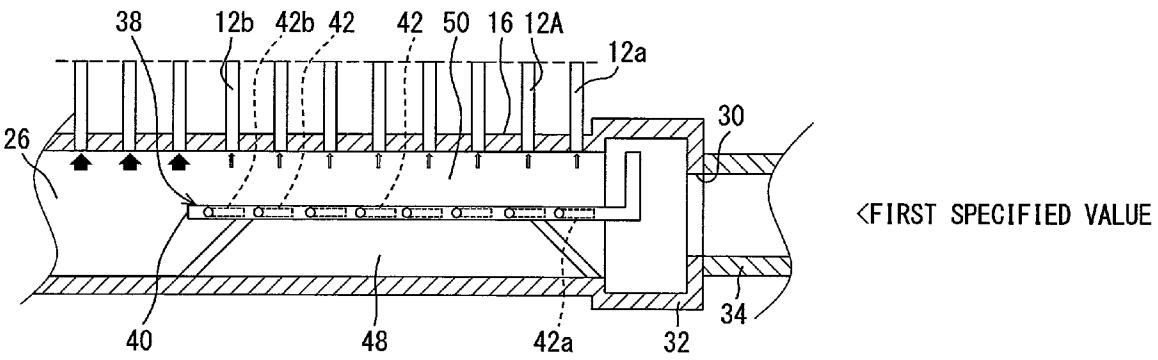
FIG. 9 is a cross sectional view of the inlet tank when the fluid pressure in the inlet tank space is below the first specified value according to a second embodiment.

As shown in FIG. 9, when the fluid pressure of the thermal fluid in the inlet tank space 26 is below the first specified value, all of the doors 42 close the openings 44 by the biasing force of each torsion spring 58. Thus, as with the first embodiment, the thermal fluid is prohibited from flowing through the openings 44 from the first space 48 to the second space 50, whereby the flow rates of the thermal fluid flowing into the first tubes 12A may be suppressed.

Figure 10:
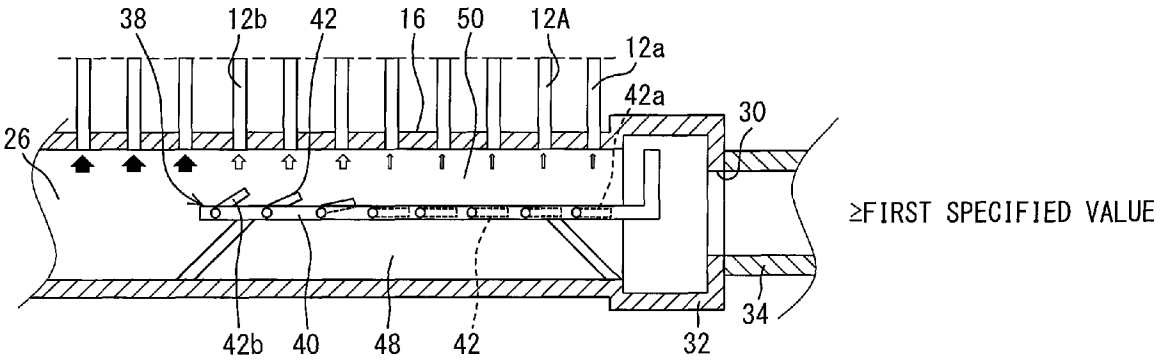
FIG. 10 is a cross sectional view of the inlet tank when the fluid pressure in the inlet tank space is at or above the first specified value according to the second embodiment.

When the fluid pressure of the thermal fluid exceeds the first specified value, some doors 42 including the farthermost doors 42*b* start rotating in the opening direction against the biasing force of the torsion springs 58 as shown in FIG. 10. More specifically, the farthermost door 42*b* starts rotating first and then some doors 42, which are close to the farthermost door 42*b*, start rotating in order. However, when the fluid pressure is around the first specified value (i.e., the engine is in the middle operation state), some of the doors 42 including the nearest door 42*a* remain closed by the biasing forces of the torsion springs 58. Therefore, during the middle operation state, the flow rates of the first tubes 12A located farther from the tank inlet 30, including the farthermost tube 12*b*, may be allowed to increase. Whereas the other doors 42 including the nearest door 42*a* remain closed despite the fluid pressure of around the first specified value. Hence, the flow rates of the first tubes 12A located close to the tank inlet 30 may be still prohibited from increasing during the middle operation state.

When the fluid pressure of the thermal fluid farther increases (i.e., the engine is in a state between the middle operation state and the high operation state), the remaining doors 42 including the nearest door 42*a* start rotating against the biasing force of the torsion springs 58, as shown in FIG.

11. Thus, the flow rates of the first tubes 12A close to the tank inlet 30 may be also allowed to increase.

Figure 11:
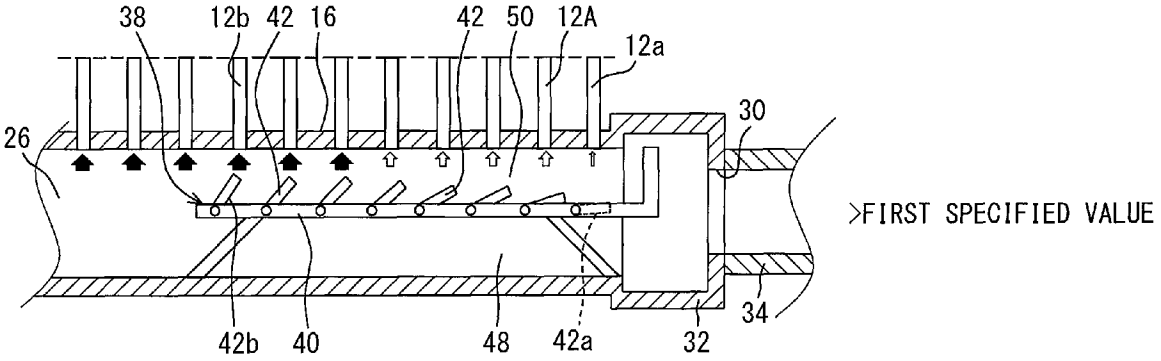
FIG. 11 is a cross sectional view of the inlet tank when the fluid pressure in the inlet tank space is more above the first specified value according to the second embodiment.

As shown in FIG. 11, the doors 42 farther from the tank inlet 30, including the farthermost door 42*b*, further rotate. As a result, the flow rates of the first tubes 12A farther from the tank inlet 30 further increase. In other words, the dynamic baffle 38 may increase the flow rates of the first tubes 12A proportionally with the fluid pressure of the thermal fluid, as with the first embodiment. As described above, the dynamic baffle 38 may first increase the flow rates of the first tubes 12A located farther from the tank inlet 30. Therefore, desirable distribution of the thermal fluid to the first tubes 12A including the farthermost tube 12*b* may be provided when the engine is in an operation state between the middle operation state and the high operation state.

Figure 12:
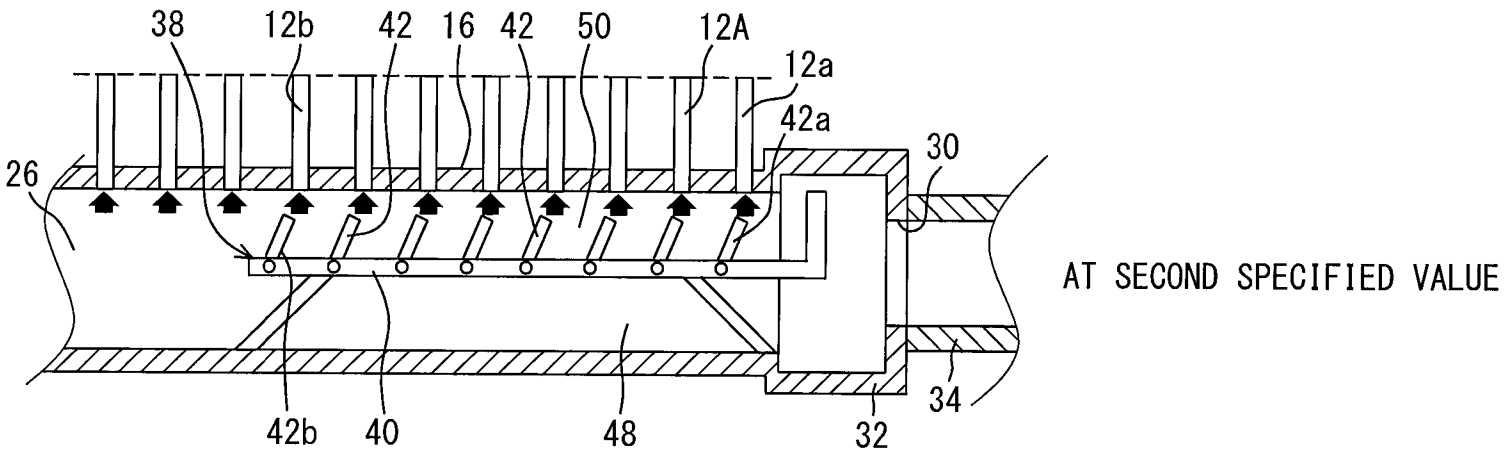
FIG. 12 is a cross-sectional view of the inlet tank when the fluid pressure in the inlet tank space is at the second specified value according to the second embodiment.

When the fluid pressure of the thermal fluid reaches the second value (i.e., the engine is in the high operation state), all doors 42 rotate to the maximum angle, as shown in FIG. 12. Thus, as with the first embodiment, the flow rates of all of the first tubes 12A are increased, whereby the desirable distribution of the thermal fluid across the core 24 may be provided.

(Other Embodiments)

Figure 13:
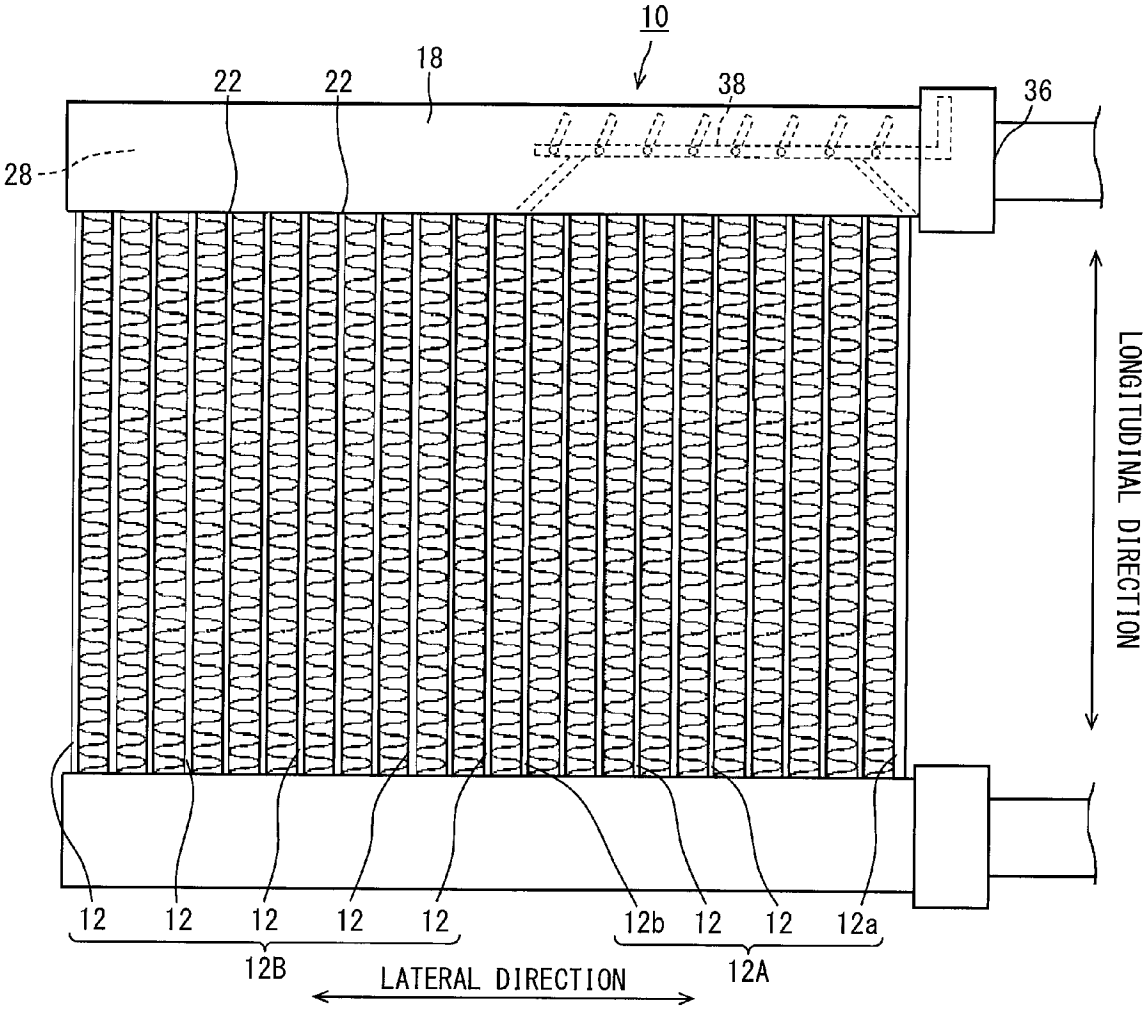
FIG. 13 is a diagram illustrating the heat exchanger according to another embodiment.

In the above-described embodiments, the dynamic baffle 38 is disposed inside the inlet tank 16. However, as shown in FIG. 13, the dynamic baffle 38 may be disposed inside the outlet tank 18. Specifically, the dynamic baffle 38 is disposed inside the outlet tank space 28 to be located close to the tank outlet 36. In this case, the dynamic baffle 38 is configured to adjust a respective flow rate at each tube outlet 22 of the first tubes 12A.

In the above-described embodiments, each door 42 rotates by the fluid pressure of the thermal fluid against the biasing force of each torsion spring 58, i.e., the door 42 mechanically rotates. Alternatively, the door 42 may be electrically rotated. For example, the dynamic baffle 38 may be provided with a motor (not shown) for controlling the rotations of the doors 42. The motor may control the doors 42 to rotate according to the fluid pressure of the thermal fluid in the inlet tank space 26.

In the above-described embodiments, the torsion spring 58 serves as a biasing member that applies a biasing force to the door 42 to close the opening 44. Alternatively, another spring, such as a flat spring (not shown), may be used as the biasing member.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed. As used herein, the term "and/or" includes any and all combinations of one or more of the associated listed items.

What is claimed is:

1. A heat exchanger comprising:

a plurality of tubes through which thermal fluid flows, each of the plurality of tubes having a tube inlet;

an inlet tank having an inlet tank space within the inlet tank, the inlet tank space being in fluid communication with the plurality of tubes; and a dynamic baffle disposed in the inlet tank space, the dynamic baffle configured to adjust a flow of the thermal fluid in the inlet tank space, wherein the inlet tank space extends in a first direction along which the plurality of tubes are connected to the inlet tank, and the thermal fluid flows through the inlet tank space along the first direction from an upstream side to a downstream side, the inlet tank has a tank inlet at the upstream side of the inlet tank in the first direction, the inlet tank space receives the thermal fluid through the tank inlet, the thermal fluid flowing out of the inlet tank space at the tube inlet of each of the plurality of tubes and at a respective flow rate for each of the plurality of tubes, the plurality of tubes include a plurality of first tubes and a plurality of second tubes, the plurality of first tubes being closer to the tank inlet than the plurality of second tubes are to the tank inlet, the plurality of first tubes include a nearest tube that is, among the plurality of tubes, closest to the tank inlet, and the dynamic baffle is configured to suppress the flow rates of the plurality of first tubes when a fluid pressure of the thermal fluid in the inlet tank space is below a specified value, and increase the flow rate of at least one of the plurality of the first tubes when the fluid pressure of the thermal fluid in the inlet tank space is at or above the specified value, wherein the dynamic baffle includes a plurality of doors adjacent to the plurality of first tubes, and the plurality of doors are rotatably disposed within the inlet tank space, each of the plurality of doors configured to rotate to adjust the flow rate of a respective one of the plurality of first tubes, wherein the dynamic baffle includes a body in which the plurality of doors are rotatably disposed and a plurality of openings are formed, the plurality of openings are adjacent to respective ones of the plurality of doors, the body extends along the first direction to define a first space and a second space inside the inlet tank space, the plurality of doors and the plurality of openings are arranged along the first direction to face corresponding ones of the plurality of first tubes, the plurality of doors are configured to rotate to selectively open and close the plurality of openings, and the plurality of doors are configured to close the plurality of openings to prohibit the thermal fluid from flowing through the plurality of openings from the first space to the second space when the fluid pressure of the thermal fluid in the inlet tank space is below the specified value, thereby suppressing the flow rates of the corresponding ones of the plurality of first tubes, and open at least one of the plurality of openings to allow the thermal fluid to flow through the at least one of the plurality of openings from the first space to the second space when the fluid pressure of the thermal fluid in the inlet tank space is at or above the specified value, thereby increasing the flow rate of the at least one of the plurality of first tubes.

2. The heat exchanger according to claim 1, wherein the dynamic baffle is configured to increase the flow rates of the plurality of the first tubes concurrently when the fluid pressure of the thermal fluid in the inlet tank space is at the specified value.

3. The heat exchanger according to claim 1, wherein the plurality of first tubes include a farthermost tube that is, among the plurality of first tubes, farthermost from the tank inlet, and the dynamic baffle is configured to increase a flow rate of the farthermost tube when the fluid pressure of the thermal fluid in the inlet tank space is at the specified value.

4. The heat exchanger according to claim 1, wherein the dynamic baffle is configured to increase the flow rate of the at least one of the plurality of first tubes as the fluid pressure increases when the fluid pressure of the thermal fluid in the inlet tank space is at or above the specified value.

5. The heat exchanger according to claim 1, wherein the dynamic baffle further includes a plurality of biasing members connected to the respective ones of the plurality of doors, the plurality of biasing members are configured to apply a biasing force to the plurality of doors in a closing direction to close the plurality of openings, and the plurality of doors are configured to rotate in an opening direction, which is opposite to the closing direction, against the biasing force of the plurality of biasing members to open the at least one of the plurality of openings when the fluid pressure of the thermal fluid in the inlet tank space is at or above the specified value.

6. The heat exchanger according to claim 5, wherein the biasing force of each of the plurality of biasing members has a substantially same value.

7. The heat exchanger according to claim 5, wherein one of the plurality of biasing members is located farther from the tank inlet than an other of the plurality of biasing members is from the tank inlet, and the biasing force of the one of the plurality of biasing members is less than that of the other of the plurality of biasing members.

8. The heat exchanger according to claim 5, wherein the plurality of doors are configured to rotate in the opening direction according to the fluid pressure of the thermal fluid in the inlet tank space, and the plurality of doors increase the flow rates of the plurality of first tubes as the plurality of doors rotate in the opening direction.

9. A heat exchanger comprising:

a plurality of tubes through which thermal fluid flows, each of the plurality of tubes having a tube outlet;

an outlet tank having an outlet tank space within the outlet tank, the outlet tank space being in fluid communication with the plurality of tubes; and a dynamic baffle disposed in the outlet tank space, the dynamic baffle configured to adjust a flow of the thermal fluid in the outlet tank space, wherein the outlet tank space extends in a first direction along which the plurality of tubes are connected to the outlet tank, and the thermal fluid flows through the outlet tank space along the first direction from an upstream side to a downstream side, the outlet tank has a tank outlet at the downstream side of the outlet tank in the first direction, the thermal fluid flowing into the outlet tank space at the tube outlet of each of the plurality of tubes and at a respective flow rate for each of the plurality of tubes and flowing out of the outlet tank through the tank outlet, the plurality of tubes include a plurality of first tubes and a plurality of second tubes, the plurality of first tubes being closer to the tank outlet than the plurality of second tubes are to the tank outlet, the plurality of first tubes include a nearest tube that is, among the plurality of tubes, closest to the tank outlet, and the dynamic baffle is configured to suppress the flow rates of the plurality of first tubes when the fluid pressure of the thermal fluid in the outlet tank space is below a specified value, and increase the flow rate of at least one of the plurality of the first tubes when the fluid pressure of the thermal fluid in the outlet tank space is at or above the specified value, wherein the dynamic baffle includes a plurality of doors adjacent to the plurality of first tubes, and the plurality of doors are rotatably disposed within the outlet tank space, each of the plurality of doors configured to rotate to adjust the flow rate of a respective one of the plurality of first tubes, wherein the dynamic baffle includes a body in which the plurality of doors are rotatably disposed and a plurality of openings are formed, the plurality of openings are adjacent to respective ones of the plurality of doors, the body extends along the first direction to define a first space and a second space inside the outlet tank space, the plurality of doors and the plurality of openings are arranged along the first direction to face corresponding ones of the plurality of first tubes, the plurality of doors are configured to rotate to selectively open and close the plurality of openings, and the plurality of doors are configured to close the plurality of openings to prohibit the thermal fluid from flowing through the plurality of openings from the first space to the second space when the fluid pressure of the thermal fluid in the outlet tank space is below the specified value, thereby suppressing the flow rates of the corresponding ones of the plurality of first tubes, and open at least one of the plurality of openings to allow the thermal fluid to flow through the at least one of the plurality of openings from the first space to the second space when the fluid pressure of the thermal fluid in the outlet tank space is at or above the specified value, thereby increasing the flow rate of the corresponding ones of the plurality of first tubes.

* * * * *